US005131617A

United States Patent [19]

McGarrah

[11] Patent Number: 5,131,617

[45] Date of Patent: Jul. 21, 1992

[54] VENDING MACHINE ANTIROCKING PLATE

[75] Inventor: Robert G. McGarrah, Brookfield, Conn.

[73] Assignee: PepsiCo Inc., Purchase, N.Y.

[21] Appl. No.: 396,427

[22] Filed: Aug. 21, 1989

[51] Int. Cl.[5] ..... A47B 97/00

[52] U.S. Cl. ..... 248/500; 248/681; 248/346

[58] Field of Search ..... 248/500, 501, 346, 680, 248/681, 673, 678, 510, 688, 650; 221/282, 284-286

[56] References Cited

U.S. PATENT DOCUMENTS

| | | | |
|---|---|---|---|
| 1,823,753 | 9/1931 | Muhlfeld | 248/261 |
| 2,739,773 | 3/1956 | Raugemont | 248/650 |
| 2,847,146 | 8/1958 | Obourn | 221/282 |
| 3,212,739 | 10/1965 | Morris | 248/681 |
| 3,223,245 | 12/1965 | Weitzman | 248/125 X |
| 3,613,945 | 10/1971 | Rockola | 221/295 |
| 4,700,923 | 10/1987 | Lewis, Jr. et al. | 248/500 X |
| 4,735,310 | 4/1988 | Lemery et al. | 248/680 X |
| 4,834,263 | 5/1989 | Becze | 221/282 X |

*Primary Examiner*—Karen J. Chotkowski
*Attorney, Agent, or Firm*—Scully, Scott, Murphy & Presser

[57] ABSTRACT

A vending machine antirocking plate is disclosed which is a safety feature for a soft drink vending machine to prevent rocking of the vending machine. The antirocking plate prevents oscillatory rocking of a vending machine by a potential pilferer who may attempt to attain a sufficient forward tilt of the machine to possibly dislodge soft drink containers within the vending machine to fall through the product dispensing chute. A safety problem has been incurred in this situation as the vending machines are very heavy, and can possibly fall on top of and injure the person rocking the machine or other persons in the proximity thereof. The present invention is designed to prevent such rocking motions by securing an antirocking plate to the front leveling legs of the vending machine and extending forwardly therefrom and overlying the floor, such that a person standing in front of the machine will also be standing on top of the plate. Accordingly, if the person attempts to rock the vending machine, his weight on the plate will cause the plate to prevent the front legs of the machine from lifting, thereby preventing oscillatory rocking of the vending machine. In a further disclosed embodiment, the antirocking plate extends fully under the vending machine, and is secured to both the front and rear leveling legs of the vending machine, and thereby prevents both rearward and forward tilting or rocking of the vending machine. In different embodiments, the antirocking plate can be fabricated from plastic or can be fabricated as a metal plate. Embodiments of a plastic antirocking plate preferably include metal plate inserts which lock onto the legs of the vending machine.

9 Claims, 4 Drawing Sheets

VENDING MACHINE ANTIROCKING PLATE

BACKGROUND OF THE INVENTION

1. Field of the Invention

The present invention relates generally to a safety mechanism for vending machines, and more particularly pertains to a vending machine antirocking plate, which is a safety feature for a soft drink vending machine to prevent rocking of the vending machine, which might possibly lead to the vending machine tipping over and injuring the person rocking the vending machine or other persons in the proximity thereof.

2. Discussion of the Prior Art

The vending machine antirocking plate of the present invention is a safety feature for a soft drink vending machine to prevent oscillatory rocking of the machine by a potential pilferer, who attempts to attain a sufficiently forward tilt of the machine to possibly dislodge soft drink products within the machine to fall through the product dispensing chute. A safety problem has been incurred in this situation as vending machines are very heavy, and can possibly fall on top of and injure the person rocking the machine or other persons in the proximity thereof. The present invention is designed to prevent such rocking motions by mounting an antirocking plate to the legs of the vending machine to prevent any tilting or rocking thereof.

SUMMARY OF THE INVENTION

Accordingly, it is a primary object of the present invention to provide an antirocking plate as a safety feature for a soft drink vending machine to prevent oscillatory rocking of the machine by a potential pilferer, who attempts to attain a sufficiently forward tilt of the machine to possibly dislodge soft drink products within the machine causing them to fall through the product dispensing chute.

A further object of the subject invention is the provision of an antirocking plate secured to the front leveling legs of the vending machine and extending forwardly therefrom overlying the floor, such that a person standing in front of the machine will also be standing on top of the plate. Accordingly, if the person attempts to rock the vending machine, the person's weight on the plate will cause the plate to prevent the front legs of the machine from lifting, thereby preventing oscillatory rocking of the vending machine.

In a further disclosed embodiment the antirocking plate extends fully under the vending machine, and is attached to both the front and rear leveling legs of the vending machine, and thereby prevents both rearward and forward tilting or rocking of the vending machine.

In different embodiments, the antirocking plate can be fabricated from plastic, such as from recycled PET plastic, or can be fabricated as a metal plate. Embodiments of a plastic antirocking plate preferably include metal plate inserts which lock onto the legs of the vending machine. A plastic antirocking plate typically might be one quarter inch thick, have a three feet by three feet base, and have one eight inch thick metal plate inserts therein to attach to the legs of the vending machine. The metal plate inserts are mounted near the top of the plastic plate to provide a one eight inch elevation of the metal plate inserts above the floor to provide a clearance over the bottom head of each leveling leg. Moreover, the metal plate inserts can be interchangeable between different positions to provide a universal fit to different size vending machines.

BRIEF DESCRIPTION OF THE DRAWINGS

The foregoing objects and advantages of the present invention for a vending machine antirocking plate may be more readily understood by one skilled in the art with reference being had to the following detailed description of several preferred embodiments thereof, taken in conjunction with the accompanying drawings wherein like elements are designated by identical reference numerals throughout the several views, and in which.

DETAILED DESCRIPTION OF THE DRAWINGS

Figure 1:
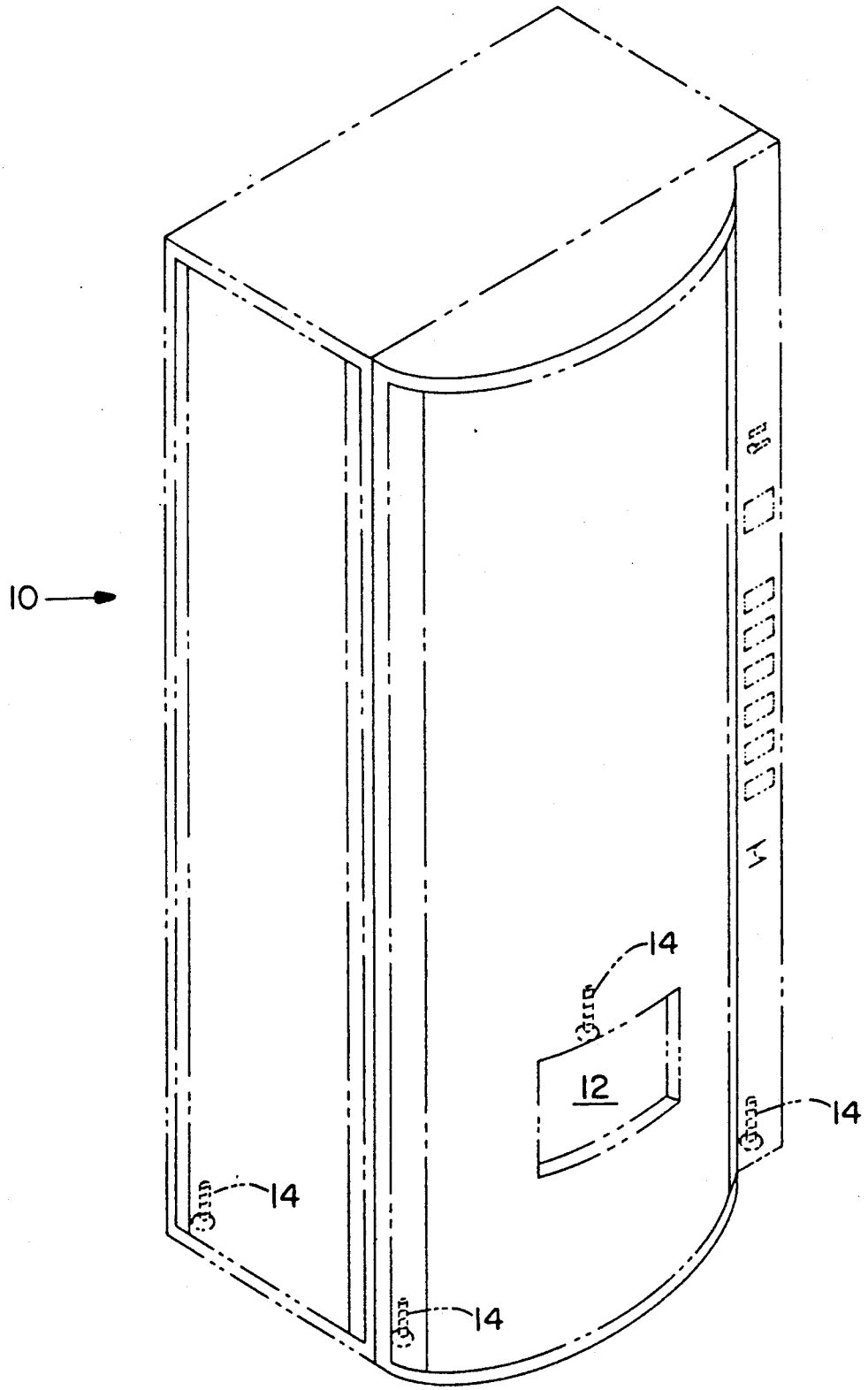
FIG. 1 is a top front, left side perspective view of a typical vending machine for beverages which may be fitted with an antirocking plate pursuant to the teachings of the present invention.

Referring to the drawings in detail, FIG. 1 illustrates a top front, left side perspective view of a typical vending machine 10 for beverages which can be equipped with an antirocking plate pursuant to the teachings of the present invention. The vending machine 10 typically has a centrally located product dispensing chute 12, and a potential product pilferer might attempt to rock the vending machine forwardly and backwardly until a sufficient forward tilt of the machine is attained to possibly cause product cans to be dislodged from within the machine and fall into the product dispensing chute.

Figure 2:
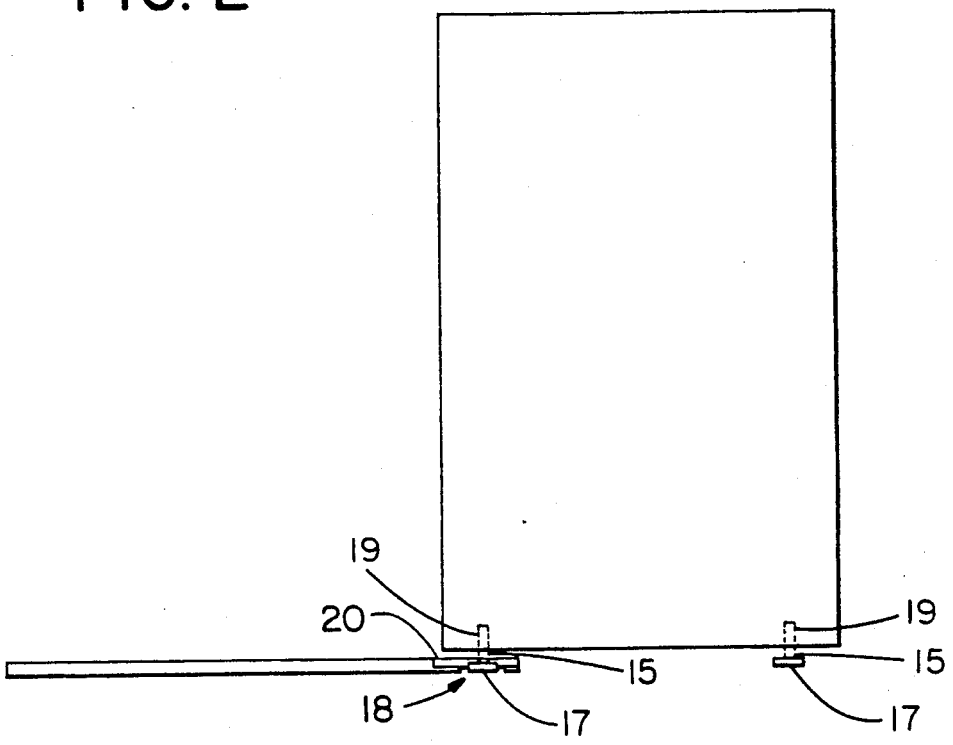
FIG. 2 illustrates a side elevational view of a first embodiment of an antirocking plate of the subject invention, which attaches to the front leveling legs of a vending machine.

The vending machine also typically comprises an adjustable leveling bolt legs 14 threadedly engaged into the frame at each corner thereof to provide for leveling of the vending machine. Referring to FIG. 2, each leveling leg comprises a central shaft 15 extending downwardly to a bottom head 17 having a larger area of contact with the floor beneath the vending machine than the cross sectional area of the central shaft 15. The central shaft 15 is threaded at its upper end, which threadedly engages an internally threaded frame member forming a securing means 19 to the vending machine. The antirocking plate of the present invention mounts to central shafts 15 of the two front leveling bolt legs, and possibly the two rear leveling both legs of the vending machine, providing a convenient retrofit application to existing vending machines.

FIG. 2 illustrates an embodiment of an antirocking plate 16 adapted to be attached to the front leveling legs 14 of the vending machine and extending forwardly therefrom and overlying the floor. such that a person standing in front of the machine will also be standing on top of the plate. Accordingly, if the person attempts to rock the vending machine, his weight on the plate will cause the plate to prevent the front legs of the machine from lifting, thereby preventing oscillatory rocking of the vending machine. The antirocking plate preferably provides a recess 18 above the bottom head of each leveling leg, such that the plate lies flat on the floor.

Figure 3:
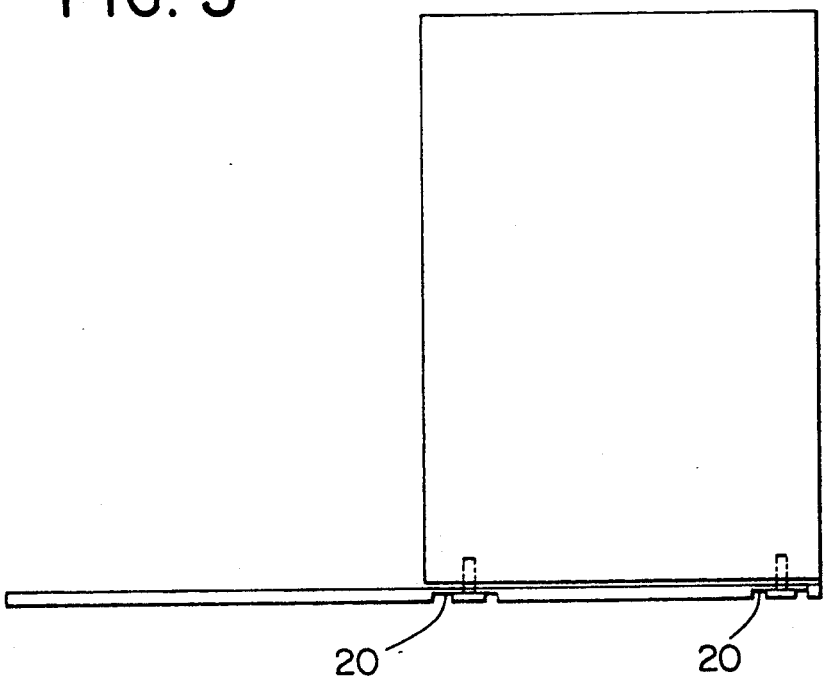
FIG. 3 illustrates a side elevational view of a second embodiment of an antirocking plate which is designed to be secured to both the front and back leveling legs of a vending machine.

FIG. 3 illustrates a side elevational view of a second embodiment of an antirocking plate which extends fully under the vending machine, and is attached to both the front and rear leveling legs of the vending machine, and thereby prevents both rearward and forward tilting of the vending machine. An advantage of this arrangement is that it prevents the vending machine from being tilted rearwardly and possibly damaging a wall adjacent thereto.

In different embodiments, the antirocking plate can be fabricated from plastic, such as from recycled PET plastic, or can be fabricated as a metal plate. Embodiments of a plastic antirocking plate preferably include metal plate inserts 20 which lock onto the legs of the vending machine. A plastic antirocking plate typically might be one quarter inch thick, have a three feet by three feet base, and have one eight inch thick metal plate inserts therein to attach to the legs of the vending machine. The metal plate inserts 20 are typically one eight inch thick, can be approximately six by twelve inches, and are mounted and embedded near the top of the plastic plate to provide a one eight inch elevation of the metal plate insert above the floor to provide a clearance over the bottom head or base of each leveling leg. It is also possible in different embodiments to add one or more stiffening ribs at the metal plate inserts to reinforce those areas.

Figure 4:
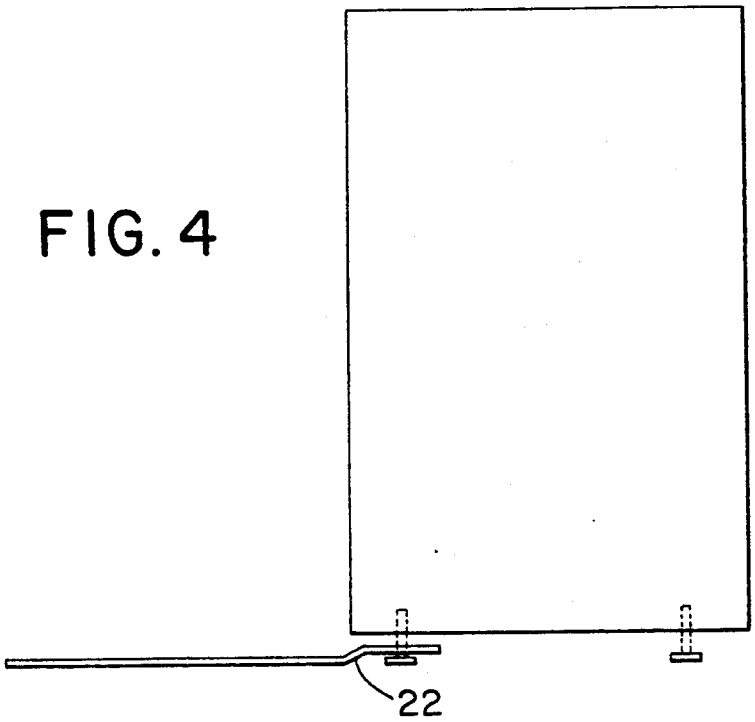
FIG. 4 illustrates a side elevational view of a further embodiment of an antirocking plate secured to the front leveling legs of a vending machine.

FIG. 4 illustrates a further embodiment of an antilocking plate constructed of one metal plate and bent upwardly at 22 to provide space for the heads of the leveling legs.

Figure 5:
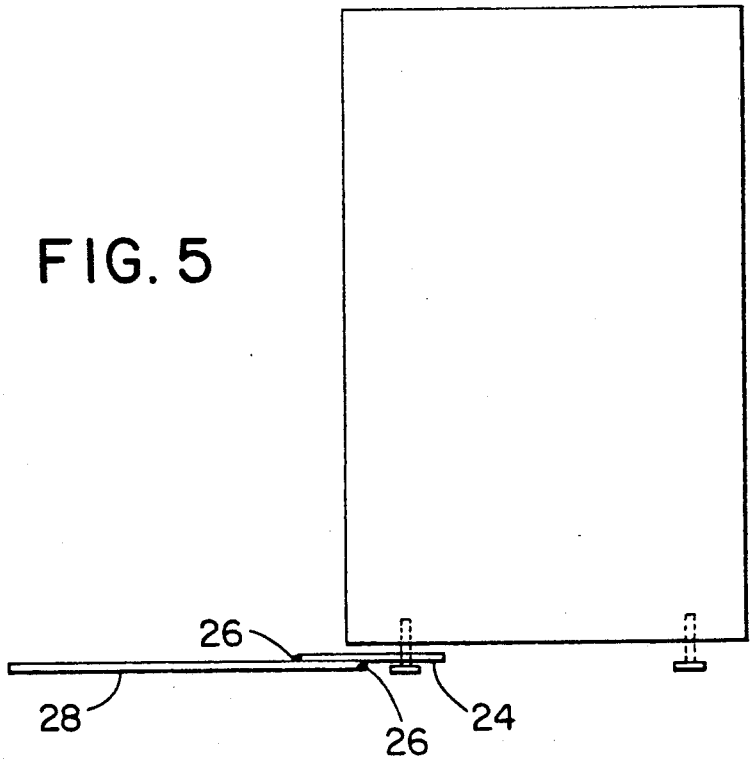
FIG. 5 illustrates another embodiment of an antirocking plate similar to that of FIG. 4, but formed of several plates welded together.

FIG. 5 illustrates a further embodiment in which the plate section 24 attaching to the leveling legs of the vending machine is overlaid and attached as by welding at 26 to a base antirocking plate 28 lying flat on the floor in front of the vending machine.

Figure 6:
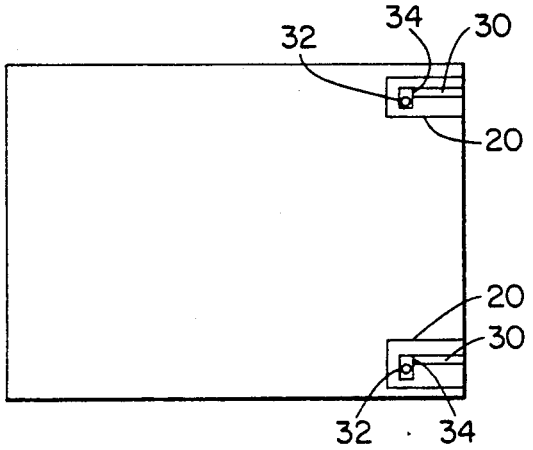
FIG. 6 illustrates a top plan view of an embodiment of an antirocking plate pursuant to the present invention.

FIG. 6 is a top plan view of an antirocking plate of the type illustrated in FIG. 2, and shows the metal plate inserts 20 having an L shaped slot 30 to receive the shaft 32 of a leveling leg. A spring biased toggle gate 34 allows the leveling leg shaft 32 to pass therethrough as the antirocking plate is initially secured to the vending machine, and then is spring biased to a closed position to retain the leveling leg in the short bottom leg of the L shaped slot.

Figure 7:
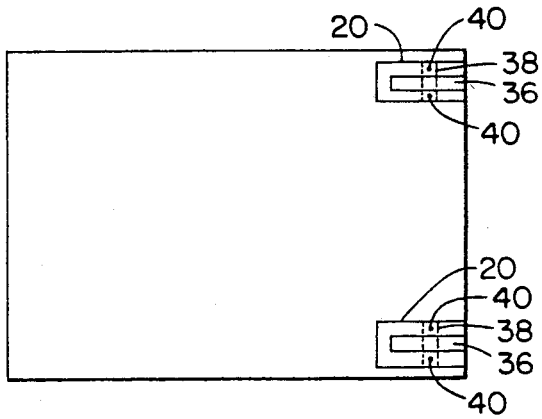
FIG. 7 illustrates a top plan view of a further embodiment of an antirocking plate.

FIG. 7 is a top plan view of a further antirocking plate of the type illustrated in FIG. 2, and illustrates a linear slot 36 extending straight backwardly in the metal plate insert. A locking cross bar 38 can be suitably secured in place at 40 after the antirocking plate is secured to the vending machine, as by pins, rivets, cotter pins, or any suitable attachment means. The attachment means 40 is normally hidden from view, and it is unlikely that a potential pilferer would attempt to dismantle it in an out-of-sight inconvenient location under the machine, and accordingly the attachment means need not always be of a locking type.

Figure 8:
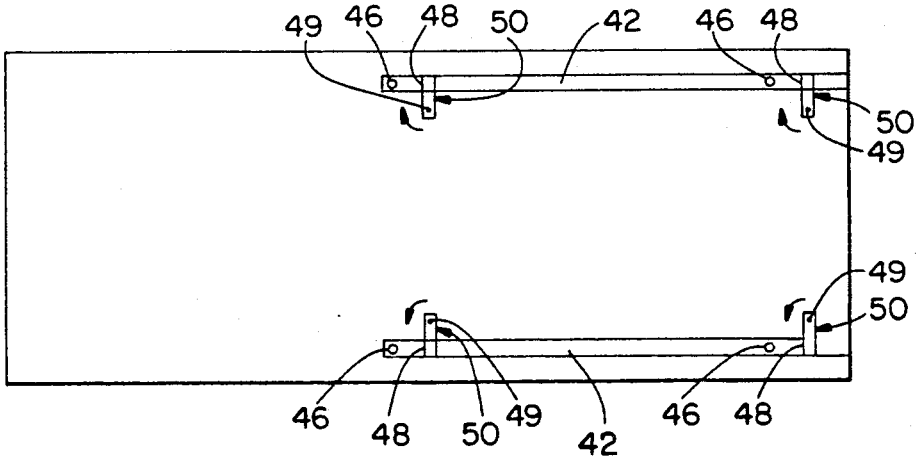
FIG. 8 illustrates a top plan view of another embodiment of an antirocking plate, designed to be secured to both the front and rear leveling legs of a vending machine.

FIG. 8 illustrates a top plan view of an antilocking plate of the type illustrated in FIG. 3, and includes two rearwardly extending slots 42, one on each side of the plate, for receiving both left or right leveling leg shafts 46 of the vending machine. The securing means can be simply a spring biased cross bar 48, spring biased closed, as by a spring on each pivot pin 49, against a closing limit stop 50. This embodiment simply slides forward into place on the vending machine, and the spring biased latches 48 simply allow a leveling leg to pass thereby and then are spring biased back into a closed position to secure the antirocking plate to the vending machine.

In some embodiments, the plate inserts 20 can have a slot in an off-center position, as in FIG. 6, and be interchangeably positioned in one of two positions in the antirocking plate to provide a variable spacing between the slots of the left and right metal inserts, to provide a more universal fitting arrangement. The width of the individual slots can also be varied, and a washer placed over the bottom head of each leveling leg would allow a wider, more accommodating slot to be utilized.

While several embodiments and variations of the present invention for an antirocking plate for a vending machine are described in detail herein, it should be apparent that the disclosure and teachings of the present invention will suggest many alternative designs to those skilled in the art.

What is claimed is:

1. An antirocking plate for a vending machine, to prevent rocking of the vending machine, which is heavy when filled with vended products and might lead to tipping over of the vending machine and injury to persons in immediate proximity to the vending machine, comprising:

a. a vending machine for vending consumer products having two front corner legs and two rear corner legs therefor, with each leg comprising a central shaft extending downwardly form a securing means at which it is secured to the vending machine to a bottom head having a larger area of contact with the floor beneath the vending machine than the cross sectional area of the central shaft; and b. an antirocking plate including at least one securing aperture encompassing and securing the central shafts of at least the two front corner legs of said vending machine, and said antirocking plate extending forwardly therefrom and overlying the floor, such that a person standing in front of the vending machine will also be standing on top of the plate, whereby if the person attempts to rock the vending machine, the person's weight on the plate will cause the plate to prevent the front legs of the vending machine from lifting, thereby preventing oscillatory rocking of the vending machine.

2. An antirocking plate for a vending machine as claimed in claim 1, said at least one securing aperture of said antirocking plate being secured to the central shafts of both the front and rear legs of the vending machine, thereby preventing both rearward and forward tilting of the vending machine.

3. An antirocking plate for a vending machine as claimed in claim 1, said at least one securing aperture of said antirocking plate defining an elongated slot extending rearwardly along each of its left and right sides in which the central shafts of the leveling legs of the vending machine are slideably engaged, and a latch means for locking a central shaft of a leg of the vending machine in said elongated slot.

4. An antirocking plate for a vending machine as claimed in claim 1, said antirocking plate comprising a plastic plate having at least one metal plate insert defining each securing aperture for attachment to the central shafts of the legs of the vending machine.

5. An antirocking plate for a vending machine as claimed in claim 4, at least one metal plate insert being interchangeable between different positions in the antirocking plate to provide different locations for attachment to different positions of legs on different vending machines, thereby providing a universal fit.

6. An antirocking plate for a vending machine as claimed in claim 1, said antirocking plate comprising a metal plate having raised portions at the securing apertures encompassing and securing the central shafts of the legs of the vending machine to provide a clearance above the bottom heads of the leveling legs.

7. An antirocking plate for a vending machine as claimed in claim 1, said antirocking plate having latches to secure said securing apertures to the legs of the vending machine.

8. An antirocking plate for a vending machine as claimed in claim 1, said front legs of the vending machine comprising leveling legs, and the upper portions of said leveling legs being threaded and threadedly engaging a frame member of the vending machine at said securing means.

9. An antirocking plate for a vending machine as claimed in claim 1, said vending machine comprising a soft drink container vending machine.

* * * * *